US012352146B2

(12) United States Patent
Almajid et al.

(10) Patent No.: US 12,352,146 B2
(45) Date of Patent: Jul. 8, 2025

(54) METHOD FOR WELL STIMULATION USING NANOBUBBLES

(71) Applicant: Saudi Arabian Oil Company, Dhahran (SA)

(72) Inventors: Muhammad Majid Almajid, Qatif (SA); Amr Abdel-Fattah, Dhahran (SA); Waheed Syed Arshad, Mississauga (CA); Afnan Mashat, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/464,455

(22) Filed: Sep. 11, 2023

(65) Prior Publication Data

US 2025/0084740 A1 Mar. 13, 2025

(51) Int. Cl.
*E21B 43/16* (2006.01)
*E21B 43/25* (2006.01)

(52) U.S. Cl.
CPC ..... *E21B 43/255* (2013.01); *E21B 43/164* (2013.01)

(58) Field of Classification Search
CPC ..... E21B 43/255; E21B 43/164; E21B 33/16; E21B 33/26
See application file for complete search history.

(56) References Cited

U.S. PATENT DOCUMENTS

| | | | | |
|---|---|---|---|---|
| 6,166,095 | A | 12/2000 | Bryan et al. | |
| 6,302,209 | B1 | 10/2001 | Thompson, Sr. et al. | |
| 6,638,885 | B1 | 10/2003 | McGrath et al. | |
| 7,875,654 | B2 | 1/2011 | Hong et al. | |
| 8,722,812 | B2 | 5/2014 | Yabu et al. | |
| 8,985,206 | B2 | 3/2015 | Morvan et al. | |
| 9,512,398 | B2 | 12/2016 | Wood et al. | |
| 9,708,525 | B2 | 7/2017 | Suresh et al. | |
| 9,873,827 | B2 | 1/2018 | Chakraborty et al. | |
| 10,053,966 | B2 | 8/2018 | Hardin et al. | |
| 10,316,873 | B2 | 6/2019 | Weitz et al. | |
| 10,392,555 | B2 | 8/2019 | Giro et al. | |
| 10,934,475 | B2 | 3/2021 | Ren et al. | |
| 11,472,709 | B2 | 10/2022 | Wang et al. | |
| 11,572,282 | B2 | 2/2023 | Wang | |
| 11,585,195 | B2 | 2/2023 | Hardin et al. | |
| 11,827,850 | B2 | 11/2023 | Wang | |
| 2008/0206317 | A1 | 8/2008 | Johnsson et al. | |
| 2010/0305219 | A1 | 12/2010 | Granick et al. | |
| 2010/0314118 | A1 | 12/2010 | Quintero et al. | |
| 2013/0000886 | A1* | 1/2013 | Mcgee | E21B 43/003 166/177.2 |
| 2015/0175876 | A1 | 6/2015 | Resasco et al. | |
| 2015/0218435 | A1 | 8/2015 | Suresh et al. | |
| 2015/0218921 | A1 | 8/2015 | Suresh | |
| 2015/0299369 | A1 | 10/2015 | Ausserre et al. | |
| 2016/0068736 | A1* | 3/2016 | De Stefano | C09K 8/94 507/202 |
| 2016/0319209 | A1 | 11/2016 | Shiode et al. | |
| 2017/0173546 | A1 | 6/2017 | Cheng et al. | |
| 2018/0155612 | A1* | 6/2018 | Xu | C09K 8/584 |
| 2018/0346798 | A1 | 12/2018 | Abdel-Fattah et al. | |
| 2018/0362838 | A1* | 12/2018 | Skiba | E21B 43/267 |
| 2019/0016943 | A1 | 1/2019 | Ren et al. | |
| 2019/0093463 | A1* | 3/2019 | Hardin | C09K 8/70 |
| 2019/0374916 | A1 | 12/2019 | Sherman et al. | |
| 2020/0290879 | A1 | 9/2020 | Chang et al. | |
| 2020/0369949 | A1* | 11/2020 | Gizzatov | C09K 8/584 |
| 2021/0107798 | A1 | 4/2021 | Wang | |
| 2022/0025248 | A1 | 1/2022 | Wang et al. | |
| 2022/0090473 | A1* | 3/2022 | Hardin | E21B 43/164 |
| 2023/0002234 | A1 | 1/2023 | Wang et al. | |
| 2024/0034925 | A1 | 2/2024 | Wang et al. | |

FOREIGN PATENT DOCUMENTS

| | | |
|---|---|---|
| CA | 3154909 | 4/2021 |
| CN | 108778475 | 11/2018 |
| CN | 111303853 | 6/2020 |
| KR | 102151481 | 9/2020 |
| WO | WO 2017015120 | 1/2017 |
| WO | WO 2017210424 | 12/2017 |
| WO | WO 2019027817 | 2/2019 |
| WO | WO 2021073780 | 4/2021 |

OTHER PUBLICATIONS

Chen et al., "Synthesis of ordered lamellar supermicroporous silica with rigid neutral and long-chain cationic composite templating route," Plos One, Apr. 26, 2019, 14(4):3-5, 13 pages.
Constantin et al., "Lamellar $L_\alpha$ mesophases doped with inorganic nanoparticles," Minireview, Chem. Phys. Chem., Feb. 2014, 15:1270-1282, 12 pages.
Esmaeilzadeh et al., "Effect of $ZrO_2$ nanoparticles on the interfacial behavior of surfactant solutions at air-water and n-heptane-water interfaces," Fluid Phase Equilibria, Jan. 2014, 361:289-295, 7 pages.
He et al., "One-pot Facile Synthesis of Janus Particles with Tailored Shape and Functionality," Electronic Supplementary Material (ESI) for Chemical Communications, The Royal Society of Chemistry, 2011, 17 pages.
Holm et al., "Synthesis, Characterization, and Light-Induced Spatial Charge Separation in Janus Graphene Oxide," Chem. Mater., Feb. 2018, 30:2084-2092, 9 pages.
Hu et al., "Fabrication, properties and applications of Janus particles," Chemical Society Reviews, 2012, 41:4356-4378, 23 pages.
Liang et al., "Janus hollow spheres by emulsion interfacial self-assembled sol-gel process," Chemical Communications, Jan. 2011, 47(4):1231-1233, 3 pages.

(Continued)

*Primary Examiner* — Silvana C Runyan
(74) *Attorney, Agent, or Firm* — Fish & Richardson P.C.

(57) ABSTRACT

A composition and methods are provided for stimulating a well with nanobubbles. An exemplary method includes obtaining a stimulation fluid and generating a nanobubbles solution, wherein the nanobubbles solution includes nano-sized bubbles in the stimulation fluid. The nanobubbles solution is injected into the oil well.

8 Claims, 5 Drawing Sheets

(56) References Cited

OTHER PUBLICATIONS

Luo et al., "Nanofluid of graphene-based amphiphilic Janus nanosheets for tertiary or enhanced oil recovery: High performance at low concentration," Proceedings of the National Academy of Sciences of USA (PNAS), Jul. 12, 2016, 113(28):7711-7716, 6 pages.
Luo et al., "Secondary Oil Recovery Using Graphene-Based Amphiphilic Janus Nanosheet Fluid at an Ultralow Concentration," Industrial & Engineering Chemistry Research, Sep. 2017, 56:11125-11132, 25 pages.
McGrail et al., "Selective Mono-Facial Modification of Graphene Oxide Nanosheets In Suspension," Chemical Communications, 2016, 52:288-291, 4 pages.
Meyre et al, "Radiation-Induced Synthesis of Gold Nanoparticles within Lamellar Phases. Formation of Aligned Colloidal Gold by Radiolysis," Langmuir, 2008, 24(9): 4421-4425, 5 pages.
Mumtaz et al., "Synergisitc Effects of Surfactants Mixture for Foam Stability Measurements for Enhanced Oil Recovery Applications," Society of Petroleum Engineers, 2015, SPE Saudi Arabia Section Annual Technical Symposium and Exhibition in Al-Khobar, Saudi Arabia, SPE-178475-MS, Apr. 2015, 11 pages.
Negin et al., "Application of nanotechnology for enhancing oil recovery—A review," Petroleum, 2016, 2(4):324-333, 21 pages.
Negin et al., "Most common surfactants employed in chemical enhanced oil recovery," Petroleum, 2017, 3:197-211, 15 pages.
Ng et al., "Graphene-based two-dimensional Janus materials," NPG Asia Materials, Apr. 2018, 10(4):1-21, 21 pages.
Peng et al., "A review of nanomaterials for nanofluid enhanced oil recovery," RSC Advanced, 2017, 7:32246-32254, 9 pages.
Perro et al., "Production of large quantities of "Janus" nanoparticles using wax-in-water emulsions," Colloids and Surfaces A: Physicochem. Eng. Aspects 332, 2009, 57-62, 6 pages.
Roncoronili et al., "Enhancement of a Foaming Formation with Zwitterionic Surfactants for FOR Control Application in Harsh Reservoir Conditions" 20th European Symposium on Improved Oil Recovery, Pau, France, Apr. 2019, 16 pages.
Senthilkumar et al., "An investigation of nanobubbles in aqueous solutions for various applications," Applied Nanoscience, Jul. 2018, 8(6):1557-1567, 11 pages.
Sharma et al., "Wettability Alteration in High-temperature and High-salinity Carbonate Reservoirs," SPE 147306, Society of Petroleum Engineers (SPE), presented at the SPE Annual Technical Conference and Exhibition, Oct. 30-Nov. 2, 2011, SPE Journal 18(4):646-655, Aug. 2013, 15 pages.
Vatanparast et al., "Wettability alteration of low-permeable carbonate reservoir rocks in presence of mixed ionic surfactants," Petroleum Science and Technology, 2011, 29(18):1873-1884, 12 pages.
Walther et al, "Janus Particles: Synthesis, Self-Assembly, Physical Properties and Applications," American Chemical Society (ACS Publications), Chem. Rev., Apr. 2013, 113(7):5194-5261, 68 pages.
Wang et al., "Stepwise interfacial self-assembly of nanoparticles via specific DNA pairing," Phys. Chem. Chem. Phys., 2007, 9:6313-6318, 8 pages.
Zhang et al., "Janus Particles: Synthesis, Self-Assembly, Physical Properties, and Applications," Chemical Review, 2013, 113:5194-5261, 14 pages.
Zhang et al., "Novel zwitterionic surfactant derived from castor oil and its performance evaluation for oil recovery," Colloids Surfaces A: Physicochemical and Engineering Aspects, 2015, 483:87-95, 42 pages.

* cited by examiner

METHOD FOR WELL STIMULATION USING NANOBUBBLES

TECHNICAL FIELD

This disclosure relates to methods of enhancing well performance in subsurface formations.

BACKGROUND

Acid stimulation is an effective method to enhance well performance in subsurface formations. In acid stimulation, an acid-based fluid such as HCl would be typically injected at various concentrations to create conductive channels to enhance the flow paths for hydrocarbons. The acid simulation fluid that is used typically involves various components depending on the desired treatment. These include a corrosion inhibitor, a surfactant, one or more types of acids, and others.

The use of $CO_2$ in acid treatment jobs is limited although $CO_2$ offers some advantages. For instance, $CO_2$ is an efficient solvent for removing formation damage and condensate banking around the wellbore. This is attributed to the CO being miscible with the condensate. The use of $CO_2$ in the acid stimulation fluid will also increase the amount of $CO_2$ avoided, thereby contributing to reducing the carbon footprint of the operation.

SUMMARY

An embodiment described herein provides a method for stimulating a well with nanobubbles. The method includes obtaining a stimulation fluid and generating a nanobubbles solution, wherein the nanobubbles solution includes nano-sized bubbles in the stimulation fluid. The nanobubbles solution is injected into the well.

Another embodiment described herein provides a composition for stimulating an oil well including nano-sized bubbles in a stimulation fluid.

Another embodiment described herein provides a manufacturing a nanobubbles fluid for stimulating an oil well with nanobubbles. The method includes mixing components to form a stimulation fluid and generating nano-bubbles in the stimulation fluid to create a nanobubbles fluid.

DETAILED DESCRIPTION

Embodiments described herein use a stimulation fluid as the base fluid for making a nanobubble solution for the stimulation treatment. As used herein, nanobubbles are nano-sized gas bubbles, for example, having a size of less than about 1 micrometer (μm), or between about 50 mm and about 700 nm, or between about 100 nm and about 500 nm.

Microbubbles have a size between about 1 μm and about 100 μm. Macro-bubbles have a size of greater than about 100 μm. The nanobubble solution is typically made by directly generating the nanobubbles in the stimulation fluid or by combining a solution containing the nanobubbles with the stimulation fluid. In various embodiments, the nanobubbles are formed from $O_2$, $CO_2$, $N_2$, air, or combinations thereof.

As opposed to nanobubbles, microbubbles, and macrobubbles have short lifespans in aqueous solutions. They tend to rise quickly to the surface and/or dissolve rapidly. By comparison, due to their small size, nanobubbles stay suspended in solution for an extended period of time, for example, ranging from several hours to several months. The increased stability of nanobubbles give the nanobubble solution a longer lifespan. Further, the nanobubbles will have a larger surface area for the same volume of gas. Currently, nanobubbles are used in multiple industrial applications such as agriculture, aquaculture, wastewater treatment, food processing, cleaning and sterilization, cooling, or extraction, among others.

Figure 1:
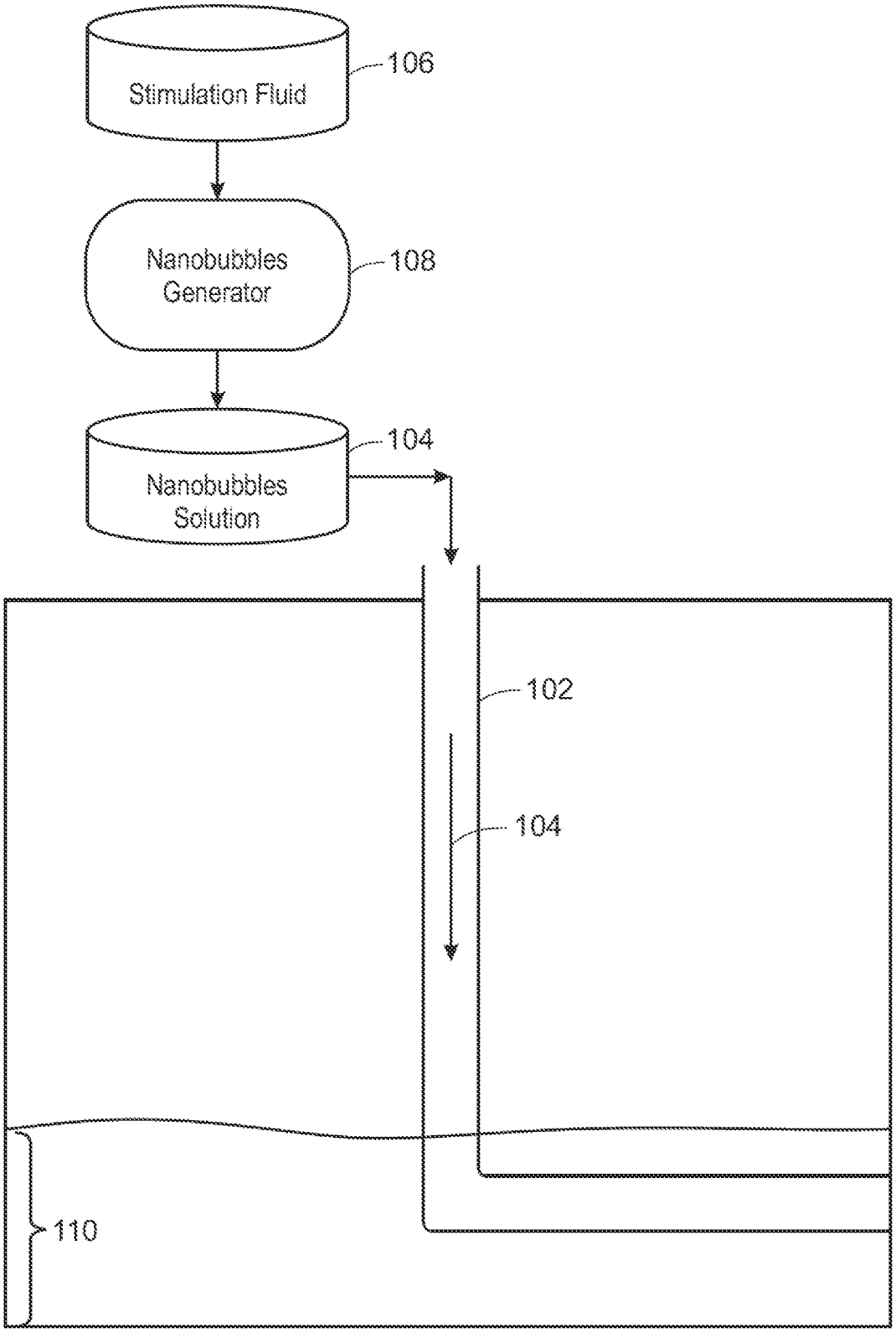
FIG. 1 is a schematic drawing of a process of stimulating a well with a nanobubbles solution.

FIG. 1 is a schematic drawing of a process 100 of stimulating a well 102 with a nanobubbles solution 104. As shown in the process 100, a stimulation fluid 106 is passed through a nanobubbles generator 108. In various embodiments, the stimulation fluid 106 includes several components typically used in stimulation fluids, such as an acid, a surfactant, a corrosion inhibitor, and other components. The acid may be an inorganic acid, an organic acid, or an acid generating compound. In various embodiments, the acid is a strong inorganic acid, such as hydrochloric acid, sulfuric acid, nitric acid, or other inorganic acids, or a combination thereof. The organic acid can include acetic acid or formic acid, among others. The acid generating compounds can include esters. The surfactant helps to improve the compatibility of the acid with the formation fluids, break down emulsions, and maintain favorable formation wettability. The surfactant can be a cationic surfactant, and an anionic surfactant, or zwitterionic surfactant, depending on the acid and well conditions. The corrosion inhibitor protects the tubulars and piping from acid corrosion. Other additives may include iron control agents, to help solubilize iron ions lowering the formation of iron scale, and $H_2S$ scavengers to lower precipitation of sulfur compounds.

In some embodiments, the nanobubbles generator 108 uses an ultrasonic transducer in a sonicator to generate the nanobubbles. For example, the nanobubbles generator 108 can generate the nanobubbles in the stimulation fluid 106 directly, by forcing dissolved gases to come out of solution as the nanobubbles. Further, a gas stream can be added to the stimulation fluid 106 prior to the sonication, which breaks the gas into the nanobubbles. In some embodiments, the nanobubbles are generated in a secondary fluid, which is then added to the stimulation fluid 106. In an embodiment, $CO_2$ is used as the gas to generate the nanobubble solution. The use of $CO_2$ may provide additional benefits over other gases due to the formation of carbonic acid. The extra energy that the nanobubbles possess makes the nanobubbles solution 104 more effective, for example, delivering the energy upon bursting or coalescing with other bubbles.

The nanobubbles solution 104, made using the stimulation fluid 106 as the base fluid, will enhance the efficiency of well stimulation jobs. The $CO_2$ nanobubbles will not increase the viscosity of the nanobubbles solution 104 versus the stimulation fluid 106, thus it can be injected into a well 102 under the same conditions as the stimulation fluid 106. In addition to the solvency efficiency of $CO_2$, the $CO_2$ nanobubbles can deliver additional thermal and mechanical energies downhole and in the near wellbore region of the formation 110 that enhance the removal of formation damage, for example, due to condensate blockage, as described herein.

Figure 2:
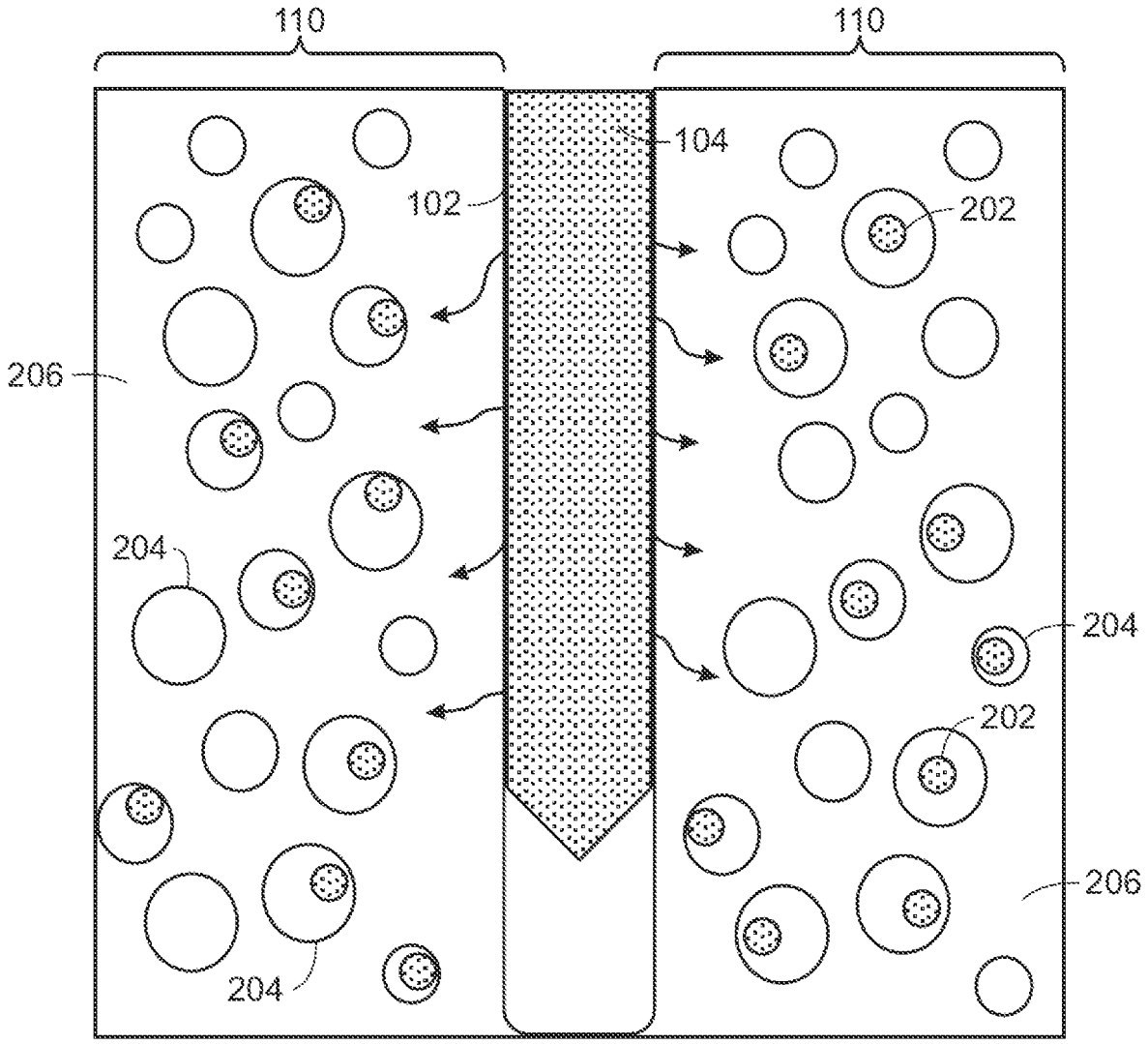
FIG. 2 is a schematic drawing of the nanobubbles solution flowing through the well and the $CO_2$ nanobubbles penetrating the pores of the surrounding rock formation.

FIG. 2 is a schematic drawing of the nanobubbles solution 104 flowing through the well 102 and the $CO_2$ nanobubbles 202 penetrating the pores 204 of the surrounding rock formation 206, for example, in the formation 110. Like numbered items are as described with respect to FIG. 1. The size of the $CO_2$ nanobubbles 202 allows them to penetrate porous tool for that are generally not accessible with other fluids. Thus, they can interact with resident fluids in these pores 204. For example, the $CO_2$ is miscible with intermediate or low carbon oils.

In gas reservoir applications, condensate blockage is a frequent problem in which the pressure of the reservoir drops below the dew point of the condensate in the natural gas, allowing the condensate to condense out of the gas phase and form a liquid phase. The condensate typically hinders the production of the well 102, and may kill the well 102, making it unable to flow. The miscibility of $CO_2$ with the condensate, would increase the ability of the condensate to flow and free the well from the condensate blockage.

Further, the $CO_2$ is a good solvent at increased pressure and temperature conditions. Thus, the $CO_2$ nanobubbles 202 added to the stimulation fluid will enhance the effectiveness of the stimulation fluid, enabling it to clear any obstructions in the formation 110 near the well 102.

Figure 3:
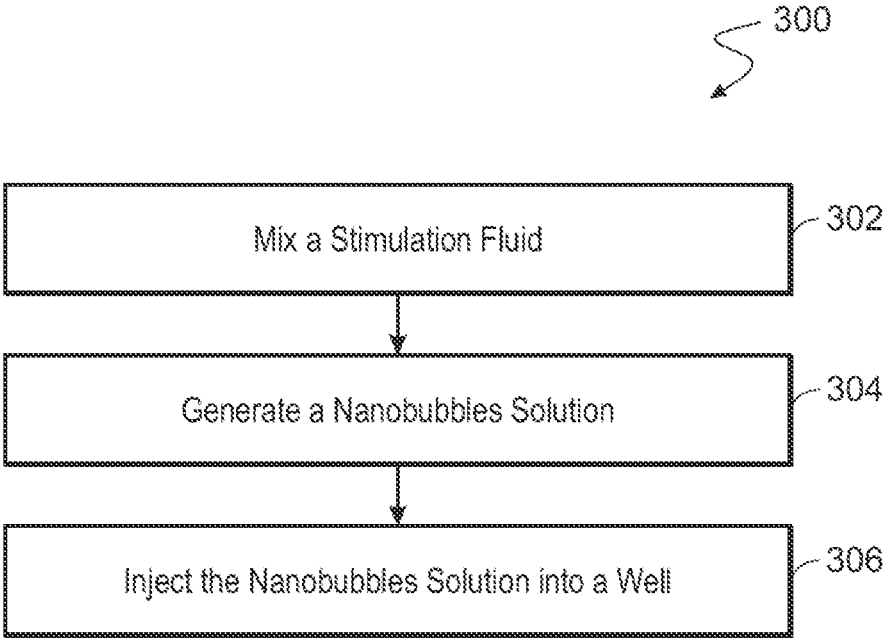
FIG. 3 is a process flow diagram of a method for stimulating a well with a nanobubbles solution.

FIG. 3 is a process flow diagram of a method 300 for stimulating a well with a nanobubbles solution. The method begins at block 302, with the mixing of a stimulation fluid. The stimulation fluid may be aqueous based, for example, mixed in a production brine or a production brine with adjustment of ionic content. In other examples, the stimulation fluid may use a simulated brine as the base fluid. The stimulation fluid may be based on oil-in-water emulsions or water-in-oil emulsions.

The stimulation fluid is prepared by adding an acid, as described herein, to the base fluid. A surfactant is added to the stimulation fluid, before or after the acid. Then, a corrosion inhibitor is added to form the final stimulation fluid.

At block 304, a nanobubbles solution is generated. As described herein, the nanobubbles solution may be generated by direct sonication of the stimulation fluid, for example, by passing it over an ultrasonic transducer to force dissolved gases, such as $CO_2$, to be released and formed the nanobubbles. A gas stream may be added to the stimulation fluid just before the stimulation fluid is passed over the ultrasonic transducer, generating the nanobubbles solution. Further, a nanobubble fluid can be separately generated, for example, using the same base fluid as the stimulation fluid, then added to the stimulation fluid to generate the nanobubbles solution.

At block 306, the nanobubbles solution is injected into a well. The viscosity and density are substantially the same as the stimulation fluid, thus, the injection conditions are similar. The viscosity and density of the nanobubbles solution is discussed further with respect to FIGS. 4 and 5.

Figure 4:
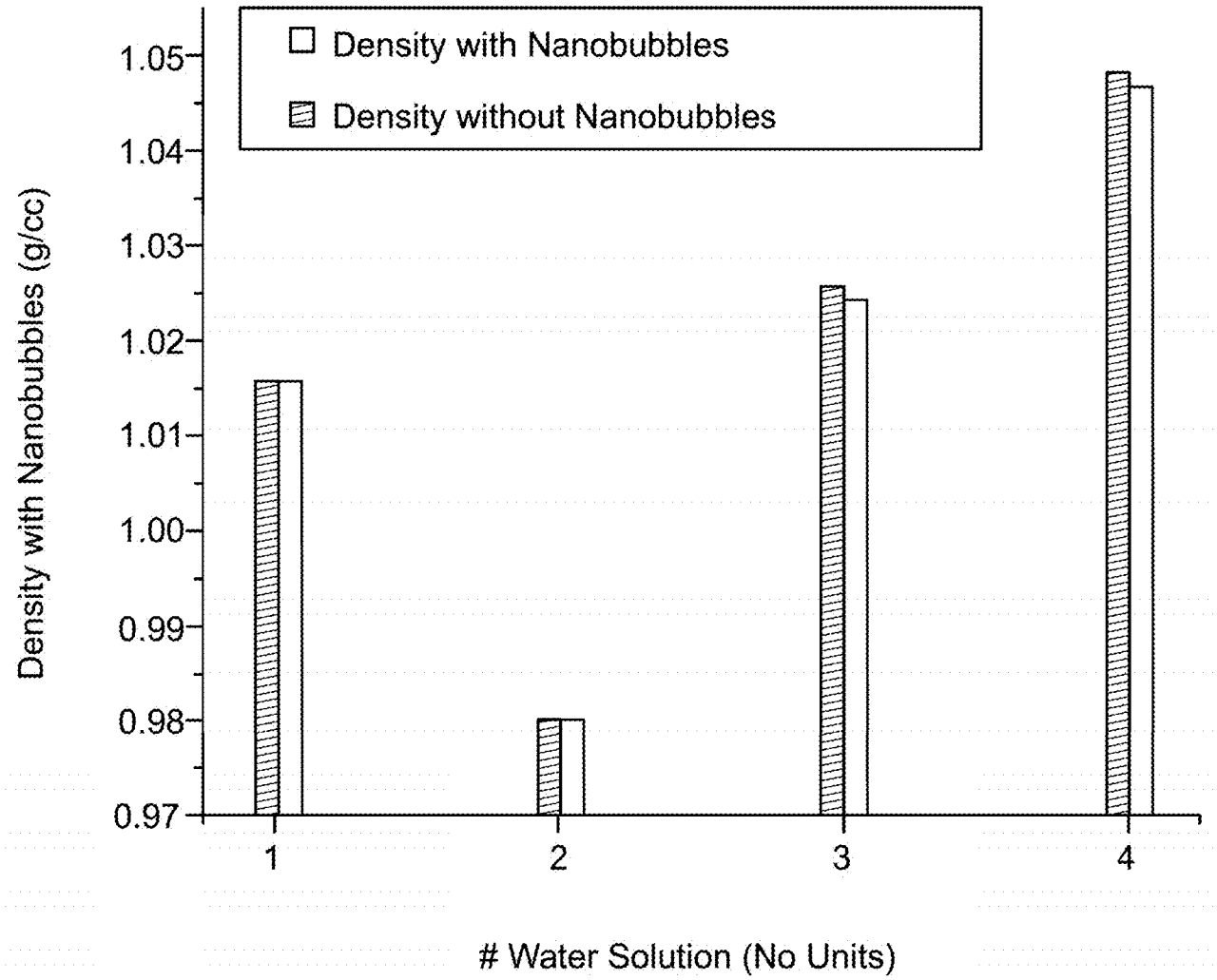
FIG. 4 is a plot of the density of water solutions under differing conditions with and without nanobubbles.

FIG. 4 is a plot of the density of different types of water solutions with and without nanobubbles. In FIG. 4, water solution 1 is tap water, 2 is distilled water, 3 is a slurry water, and 4 is seawater. As this plot shows, the nanobubble solutions are generally similar in density to the base fluid. These results indicate that the nanobubbles solution will not exert extra hydraulic pressure on the formation.

Figure 5:
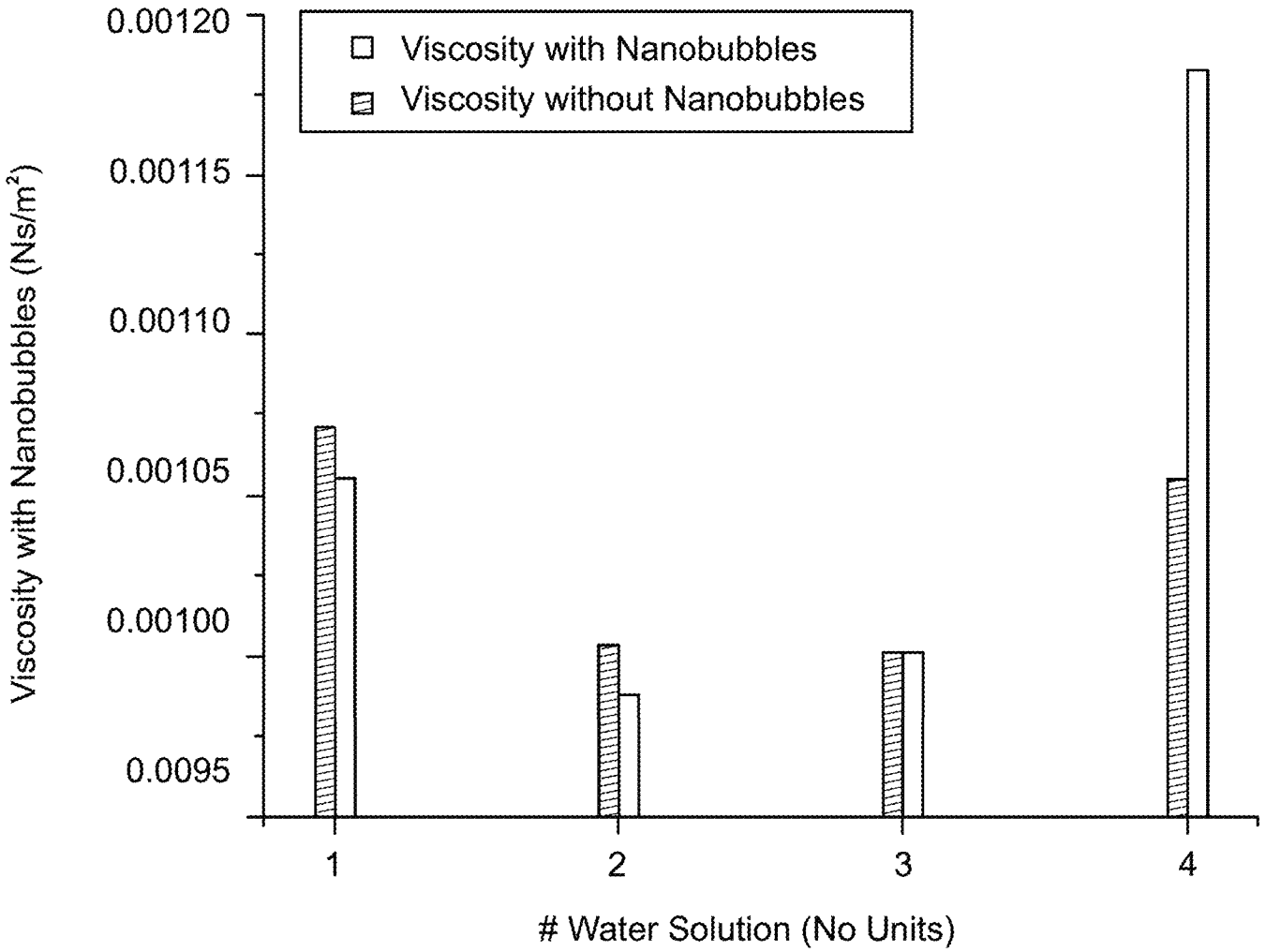
FIG. 5 is a plot of the viscosity of water solutions under differing conditions with and without nanobubbles.

FIG. 5 is a plot of the viscosity of water solutions under differing conditions with and without nanobubbles. As for FIG. 4, in FIG. 5, water solution 1 is tap water, 2 is distilled water, 3 is a slurry water, and 4 is seawater. As this plot shows, the viscosity of nanobubble solutions are typically similar to that of the base fluid. In contrast, other additives, such as polymers, may substantially increase the viscosity of the base fluid. Further, the comparable viscosity to the stimulation fluid indicates that the nanobubbles solution will be easy to flow back once the well is put on production.

Embodiments

An embodiment described herein provides a method for stimulating a well with nanobubbles. The method includes obtaining a stimulation fluid and generating a nanobubbles solution, wherein the nanobubbles solution includes nano-sized bubbles in the stimulation fluid. The nanobubbles solution is injected into the well.

In an aspect, combinable with any other aspect, the method includes mixing the stimulation fluid. Mixing the stimulation is performed by mixing an acid into a base fluid to form an acid solution, adding a surfactant to the acid solution to form an acid/surfactant solution, and adding a corrosion inhibitor to the acid/surfactant solution to form the stimulation fluid. In an aspect, the acid includes an inorganic acid, an organic acid, or an acid generating compound. In an aspect, the acid includes hydrochloric acid, sulfuric acid, or nitric acid, or any combination thereof. In an aspect, the acid includes acetic acid or formic acid.

In an aspect, combinable with any other aspect, the method includes generating the nano-sized bubbles. In an aspect, generating the nano-sized bubbles includes passing the stimulation fluid including a dissolved gas through a sonicator to generate the nanobubbles solution. In an aspect, generating the nano-sized bubbles includes injecting a gas into the stimulation fluid to form gas bubbles in the stimulation fluid and passing the stimulation fluid with the gas bubbles through a sonicator to generate the nanobubbles solution. In an aspect, generating the nano-sized bubbles includes dissolving a gas in a fluid, passing the fluid including the dissolved gas creating a nanobubbles fluid, and mixing the nanobubbles fluid with the stimulation fluid to create the nanobubbles solution.

In an aspect, combinable with any other aspect, the nano-sized bubbles remain suspended in the nanobubbles solution for more than about 60 minutes.

Another embodiment described herein provides a composition for stimulating an oil well including nano-sized bubbles in a stimulation fluid.

In an aspect, combinable with any other aspect, the stimulation fluid includes an acid, a surfactant, and a corrosion inhibitor.

In an aspect, combinable with any other aspect, the acid includes an inorganic acid, an organic acid, or an acid generating compound.

In an aspect, combinable with any other aspect, the acid includes hydrochloric acid, sulfuric acid, or nitric acid, or any combination thereof.

In an aspect, combinable with any other aspect, the acid includes acetic acid or formic acid.

In an aspect, combinable with any other aspect, the nano-sized bubbles include $CO_2$.

In an aspect, combinable with any other aspect, a density of the stimulation fluid with the nano-sized bubbles is within 0.01 g/cc of the stimulation fluid without the nano-sized bubbles.

In an aspect, combinable with any other aspect, the nano-sized bubbles have a higher miscibility with intermediate and low carbon oils than the stimulation fluid.

Another embodiment described herein provides a manufacturing a nanobubbles fluid for stimulating an oil well with nanobubbles. The method includes mixing components to form a stimulation fluid and generating nano-bubbles in the stimulation fluid to create a nanobubbles fluid.

In an aspect, the method includes generating nano-sized bubbles in an aqueous liquid; and combining the aqueous liquid with the stimulation fluid.

In an aspect, the method includes generating nano-sized bubbles in the stimulation fluid by sonication.

In an aspect, combinable with any other aspect, the method includes mixing the aqueous liquid with stimulation fluid at the well site to create the nanobubbles fluid.

Other implementations are also within the scope of the following claims.

What is claimed is:

1. A method for stimulating a well with nanobubbles, comprising:

injecting a stimulation fluid into a nanobubble generator, wherein the stimulation fluid is prepared by:

mixing an acid into a base fluid to form an acid solution;

adding a surfactant to the acid solution to form an acid/surfactant solution; and adding a corrosion inhibitor to the acid/surfactant solution to form the stimulation fluid;

generating nano-sized bubbles in the stimulation fluid by the nanobubble generator to form a nanobubbles solution, wherein the nanobubbles solution has a viscosity as that of the base fluid; and injecting the nanobubbles solution into the well.

2. The method of claim 1, wherein the acid comprises an inorganic acid, an organic acid, or an acid generating compound.

3. The method of claim 2, wherein the acid comprises hydrochloric acid, sulfuric acid, or nitric acid, or any combination thereof.

4. The method of claim 2, wherein the acid comprises acetic acid or formic acid.

5. The method of claim 1, comprising generating the nano-sized bubbles.

6. The method of claim 5, comprising passing the stimulation fluid comprising a dissolved gas through a sonicator to generate the nanobubbles solution.

7. The method of claim 5, comprising:

injecting a gas into the stimulation fluid to form gas bubbles in the stimulation fluid; and passing the stimulation fluid with the gas bubbles through a sonicator to generate the nanobubbles solution.

8. The method of claim 5, comprising:

dissolving a gas in a fluid;

passing the fluid comprising the dissolved gas creating a nanobubbles fluid; and mixing the nanobubbles fluid with the stimulation fluid to create the nanobubbles solution.

* * * * *